US008365666B1

(12) United States Patent
Hooke et al.

(10) Patent No.: US 8,365,666 B1
(45) Date of Patent: Feb. 5, 2013

(54) MODULAR BREACHING AND DEMOLITION SYSTEM

(75) Inventors: Ryan Hooke, Sparta, NJ (US); Daniel Salman, East Windsor, NJ (US); George Sudol, Kenvil, NJ (US); Brian Travers, Wayne, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 45 days.

(21) Appl. No.: 13/022,880

(22) Filed: Feb. 8, 2011

(51) Int. Cl.
*F42B 3/02* (2006.01)

(52) U.S. Cl. ..... 102/306; 102/317; 89/1.14

(58) Field of Classification Search ..... 102/301, 102/305, 306, 311, 317, 331, 293; 89/1.14
See application file for complete search history.

(56) References Cited

U.S. PATENT DOCUMENTS

| | | | | | |
|---|---|---|---|---|---|
| 4,499,828 | A * | 2/1985 | Honodel | 102/301 |
| 4,856,430 | A * | 8/1989 | Gibb et al. | 102/307 |
| 5,036,771 | A * | 8/1991 | Alford | 102/307 |
| 5,377,594 | A * | 1/1995 | Alford | 102/308 |
| 5,524,546 | A * | 6/1996 | Rozner et al. | 102/303 |
| 7,077,045 | B2 * | 7/2006 | Dietrich et al. | 89/6 |
| 7,337,703 | B2 * | 3/2008 | Sansolo | 89/1.14 |
| 7,536,956 | B2 * | 5/2009 | Sammons et al. | 102/476 |
| 7,819,063 | B1 * | 10/2010 | Lehman | 102/301 |
| 7,926,423 | B2 * | 4/2011 | Rickman et al. | 102/314 |
| 8,146,503 | B2 * | 4/2012 | Murray et al. | 102/476 |
| 2006/0201373 | A1 * | 9/2006 | Sammons et al. | 102/476 |
| 2007/0051234 | A1 * | 3/2007 | Sansolo | 89/1.14 |
| 2009/0235836 | A1 * | 9/2009 | Pratt et al. | 102/306 |
| 2009/0301334 | A1 * | 12/2009 | Murray et al. | 102/307 |
| 2010/0122639 | A1 * | 5/2010 | Rickman et al. | 102/308 |

* cited by examiner

*Primary Examiner* — Benjamin P Lee
(74) *Attorney, Agent, or Firm* — Michael C. Sachs

(57) ABSTRACT

A modular explosive breaching and demolition system comprised of inert light weight plastic assemblies, field custom hand packed or pre-loaded, utilizing for example cast-cure or press loaded explosives. The assemblies can be snapped together to make different geometeric shapes or lines as may be desired, for demolition objectives.

32 Claims, 10 Drawing Sheets

MODULAR BREACHING AND DEMOLITION SYSTEM

U.S. GOVERNMENT INTEREST

The inventions described herein may be made, used, or licensed by or for the U.S. Government for U.S. Government purposes.

BACKGROUND OF INVENTION

There exists a constant need for soldiers to enter fortified or non-fortified structures/objectives through unconventional means often referred to as breaching. With current urban type conflicts, collateral damage is a concern when insurgents reside among non-insurgents, whether in the same structure or in near-by structures. There is great need for operations which will limit collateral damage. Current theatre environments limit the ability to utilize conventional weapons to suppress an objective in a target (such as by firing for affect and demolishing such fortified or non-fortified structure), but require instead a non-conventional means of suppression through breaching, sweeping, and clearing such structures. Therefore, soldiers are often called upon to clear buildings or to produce an ingress route into a building, all while unbeknownst to the objective. This approach can allow the soldier to suprise the objective and limit confrontation, or perhaps to be able to capture the objective.

This invention provides a very versatile new explosive breaching system which can aid the warfighter in such operations. This system can be used (but is not limited) to produce an ingress route in fortified or non-fortified structures large enough for a soldier to gain access to an objective—an effective breaching charge. This system could also be used in structural demolition, conventional and non-conventional breaching, along with materiel demolition. The system could also be used in the field to dispose of excess ammunition or other war fighter materiel not wished to be abandoned for possible use by an adversary. The system is herein also referred to as the Modular Breaching and Demolition System ("MBDS").

BRIEF SUMMARY OF INVENTION

This system utilizes either inert light weight non-metallic assemblies hand packed prior to a mission, or light weight pre-loaded conventional energetic assemblies utilizing cast-cure or press loaded explosives. The system is generally made so it can fit in a soldier's ruck sack, and because it is modular, its net explosive weight can be tailored to the target needs. As an added benefit, this system is only approximately one third the weight compared to conventionally issued soldier demolition kits. As a further benefit, this system can still be classified in the same safety class as bulk explosives for the configuration where the base system is not designed to produce fragments, thus there is less red tape in distributing/obtaining the system. If desired, a soldier can still choose to incorporate a liner into any one or all of the assemblies to produce a shaped charge type explosion.

By contrast, a current breaching system fielded to the soldiers uses home made breaching charges which are field configured on the spot to carry out the mission in a timely manner, often utilize bulk explosives, detonating cord, and often also require soldiers to improvise use of surrounding/natural resources to make a frame for the explosives. Though relatively quick to setup if not relying on natural resources, such home made breaching types still are heavy (some approximately twenty eight lbs). They are also often quantity limited in availability to soldier units, consumable, and some are in a safety class different from that of bulk explosives, making for more red tape in handling. The field produced charge versions of these conventional systems might be lighter and can be made from bulk explosives readily available to soldier units and can be configured for different breaching applications; but they still rely on having the necessary natural resources to produce a frame. They also require large amounts of detonation cord to propagate the detonation around the frame. They also require more time to produce the frame/breaching charge and they also require first hand knowledge of how to reliably build and match a breaching charge to an intended target to produce the desired effects.

Both the pre-loaded and hand packed versions of this MBDS invention improve over such conventional field produced breaching charges. The MBDS will be organic to a unit of soldiers. The MBDS doesn't utilize natural resources in the surroundings and doesn't need detonation cords to propagate detonation. The MBDS is light weight and, after hand packing, or if utilizing the pre-loaded version, can be assembled in a few minutes at the last concealed and covered position. Further, if the soldier wished, a liner can be snapped into the MDBS to give a capability which field produced breaching charges currently do not have (tailored fragment generation).

In more detail, this MDBS system is comprised of multiple assemblies which can be arranged into different geometeric shapes or lines, linked together by a hinged system with clocking features and continuous cavity paths. The assemblies are made of a few inert non-metallic material pieces which snap or slide together to produce a cavity which can be hand packed with high explosives or can be pre-loaded with high explosive. Assemblies can then be used to produce any desired shape, whether square, line, T or E shape, for example. The assemblies have features which also allow a soldier to couple a shaped charge or anti-personnel liner into the MDBS if desired. Since the liner is not permanently attached to the assemblies the soldier can choose to make the MDBS a fragment producing or non-fragmenting charge depending on the target set.

A novelty in the MDBS design is the fact that it utilizes press fit joints, hinged with clocking features to produce any desired shape capable of being made with line segments. The way the cavity or high explosive in each assembly is positioned with respect to another assembly when connected and adjoined allows an ignition/detonation wave to propagate from one assembly to the next without the need of multiple detonation cords or multiple initiation points as in the conventional breaching systems. Each assembly in and of itself is also capable of having a node attached to it if desired. Such could increase the net explosive weight of the breaching charge, which would allow the MDBS breaching charge to be tailored to a particular target.

Materials used for the MDBS structure are non-metallic; this fact leads to a weight reduction in the final breaching charge/assembly compared to metallic materials. Such therefore allows for quicker implementation and functioning of the system. Nonetheless, such non-metallic materials if desired can be impregnated with metallic particles such as aluminum which can enhance the high explosive effects. Such non-metallic materials can also be reinforced with fibers to make the pieces and assemblies more rigid. Since the material is generally entirely non-metallic, all traces of the assembly are consumed during detonation which prevents enemies from tracing the system or from reverse engineering the system. Another valued feature is the ability to also introduce a fragmenting charge if desired. Such is accomplished by snapping/ coupling in a liner within the segments or otherwise by utilizing predesigned features built into the MDBS.

OBJECTS OF THE INVENTION

Accordingly, it is an object of the present invention to provide soldiers with a field demolition system which comprises inert modular pieces for customized assembly of a breaching or demolition system that the soldier requires for a particular task.

Another object of this invention is to provide soldiers with a modular field demolition system of only a few types of basic plastic components that can be snapped together by hand without need of specialized tools of finding natural resources in the field.

A yet further object of this invention is to provide soldiers with a modular field demolition system which requires no detonation cord to successfully explode such entire assembled system.

A still further object of this invention is to provide soldiers with a field demolition system of relatively light weight, and which can also be preloaded or custom hand loaded with plasticized explosive material in the field, as the soldier requires for a particular task.

A yet other object of the present invention is to provide a field demolition system which can be customized to form an inert frame which can support the positioning of trimmed sheet explosive such as detasheet® explosive between frame and target.

A still further object of the present invention is to provide a field demolition system which can be custom loaded with fragment producing shaped liners, or with fragment producing explosively formed penetrators, or a pre-formed fragment pack similar to a claymore as the soldier may require for a particular task.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

DETAILED DESCRIPTION

Figure 1B:
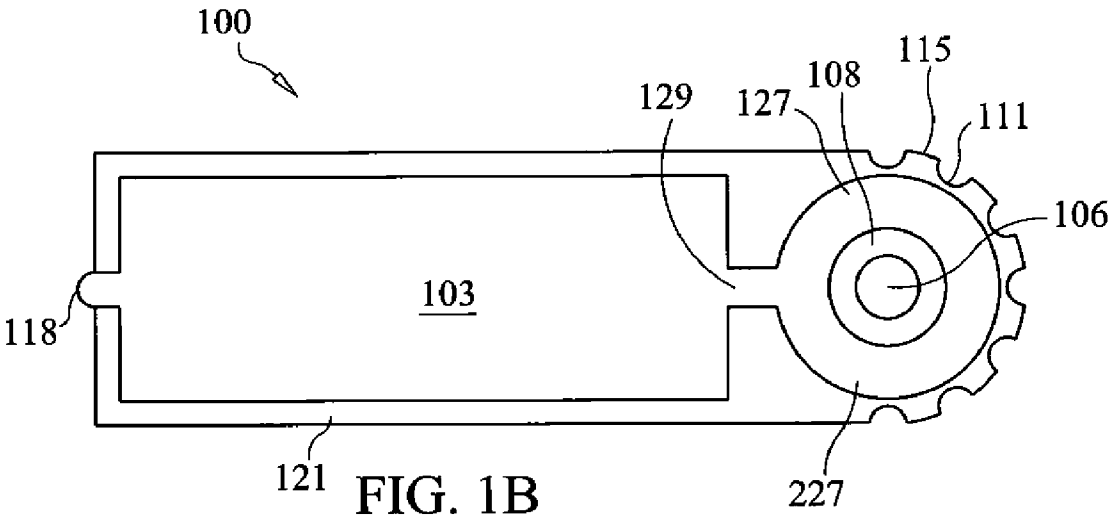
FIG. 1 shows a male piece 100, part of a leg that is used to build up a demolition device according to this invention.
Figure 1A:
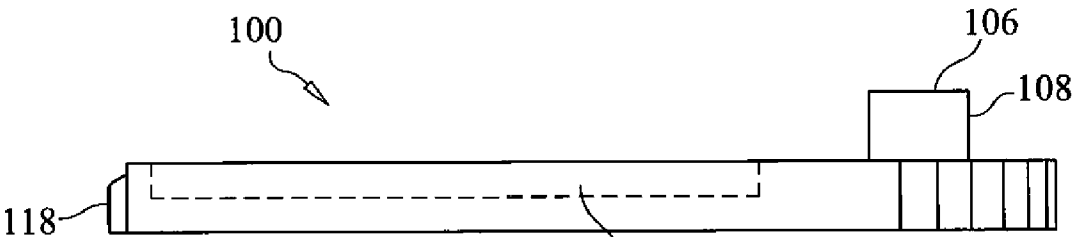
Figure 1C:
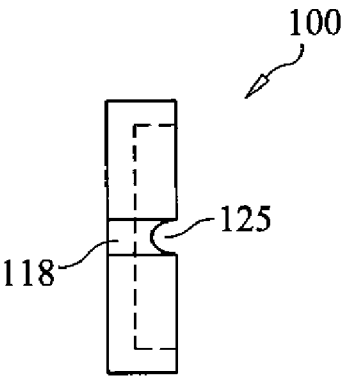
Figure 2B:
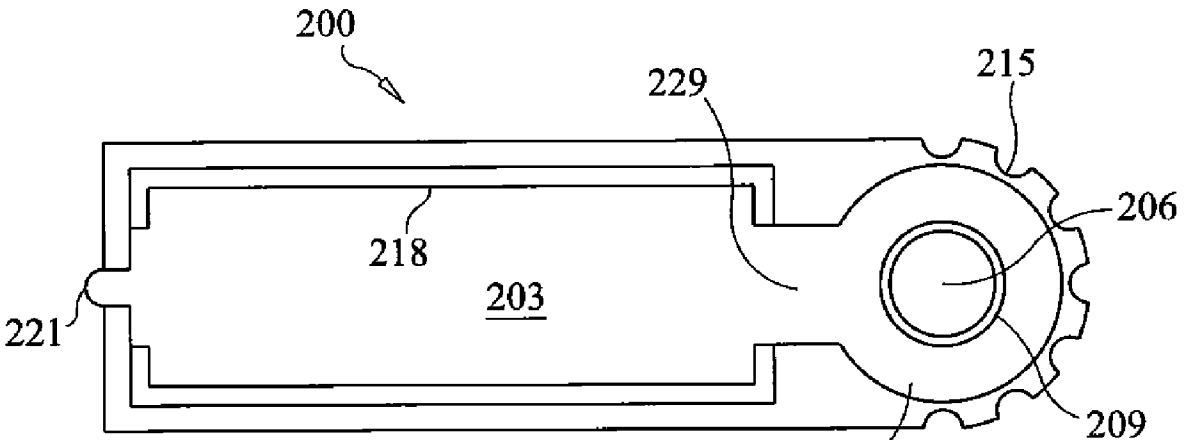
FIG. 2 shows a female piece 200, mate of male piece 100 shown in FIG. 1, used to build up a leg portion of an overall demolition device according to this invention.
Figure 2A:
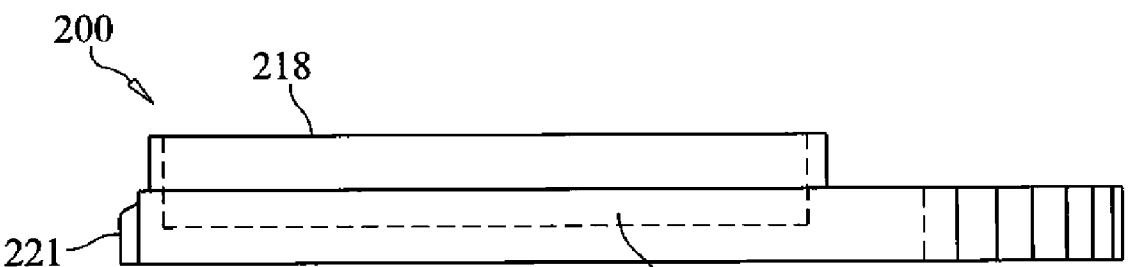
Figure 2C:
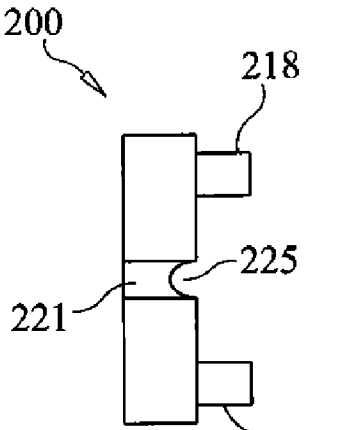

The MDBS breaching charge system according to this invention is made up essentially interconnected modular plastic "legs" which are usually filled with an explosive material; the legs are arranged in preferred patterns useful for field breaching of a target. The legs shown are made of plastic (or rubber if more flexibility of the MBDS is desired), but many other lightweight sturdy inert nonmetallic materials might be considered for substitution, if compatible to the environment used and suitable for holding explosives. The MBDS may be of nonmagnetic material, but may also employ magnetic portions (or magnets proper as portions) in the MBDS frame for additional advantage of magnetic clinging to a target set in particular cases where such is desirable. Numerous patterns for arranging/emplacing the legs in a chain should be seen as possible; while these patterns are not all fully discussed herein they are in fact best known/well know to soldiers who have performed demolition/breaching as one of their specialties. An explosive type suggested for this invention might be C-4, and would likely be handled in a plasticized form, but solid blocks of explosive are also a possibility, as well as other suitable types of explosive materials. FIG. 1 shows an inert male plastic piece 100 which is a half section piece of what will be built up into a "leg", when joined with a mating female piece 200 (see FIG. 2). Such leg may thereafter be serially joined with one or more other male and/or female type pieces to form a chain of these "legs". Piece 100 has a rectangular box cavity 103 (formed by sides 121) to hold explosives, however, box 103 also opens through passage 129 into a recessed ring area 127. Explosive is filled throughout in recessed ring 127, passage 129, as well as in box 103, and also in a passageway 125 in tab 118 (which further insures ignition contact/shock wave propagation of explosive between adjacent pieces/legs of a chain, to be explained further below). Likewise in female piece 200, there is a recessed ring shaped area 227 which through wide passage area 229 connects up with its rectangular box cavity area 203. Explosive will fill all of box 203, ring area 227, and passage 229. (Area 209, which reinforces hole 206, is higher in level than ring area 227 so as to contain the). Furthermore, there is also a passageway 225, in tab 221, which further insures ignition contact/shock wave propagation of explosive between adjacent pieces/legs of a chain. This contiguous ignition contact/shock wave propagation through all pieces/legs in a chain makes it only necessary to have a single ignition source to ignite an entire chain, instead of multiple wires, blasting caps, and detonation cord as may have been necessary with other demolition systems.

However, redundant wiring may be added to as many locations as desired to insure a successful explosion and breaching operation of the whole chain or chains of pieces/legs. The bottom side of piece 100 is generally just flat, as is the bottom side of piece 200.

Female piece 200 could be used to mate to piece 100, or else used with yet other male pieces to build up a string of legs in a chain. Piece 100 has a post 108 which will mate with hole 206 of piece 200. (Post 108 also has a slight dimple recessed top area 106). Piece 200 could be joined face to face with piece 100 so that post 108 goes into hole 206, all the while that the half cavity 103 formed by rectangular box shape 121 directly fits in to and mates into the half cavity 203 rectangular box shape 218, and the two pieces could thus be 'snapped together' and joined into a completed "leg". The leg would have a completed inside cavity which might be filled with explosive, for example. The leg is roughly an inch thick, but roughly two inches wide. The first position just mentioned can form a sealed cavity device. However, in a more preferred "second configuration" here, one of the two pieces to be joined is positioned where its longitudinal axis is 180 degrees rotated planarly than was above described. The cavity is still formed by the mating of boxes 103 and 203, (which still snap together just as snugly even in this backwards second configuration), however in this second configuration, post 108 of male piece 100 does not mate into hole 206 of female piece 200. Instead, the post 108 and the hole 206 are positioned at opposite poles, fully 180 degrees away from each other, and each is left exposed and not mated. Post 108 has a hole to allow the MBDS to be hung from a stud, strung together on a line, etc., for convenience.

Figure 5:
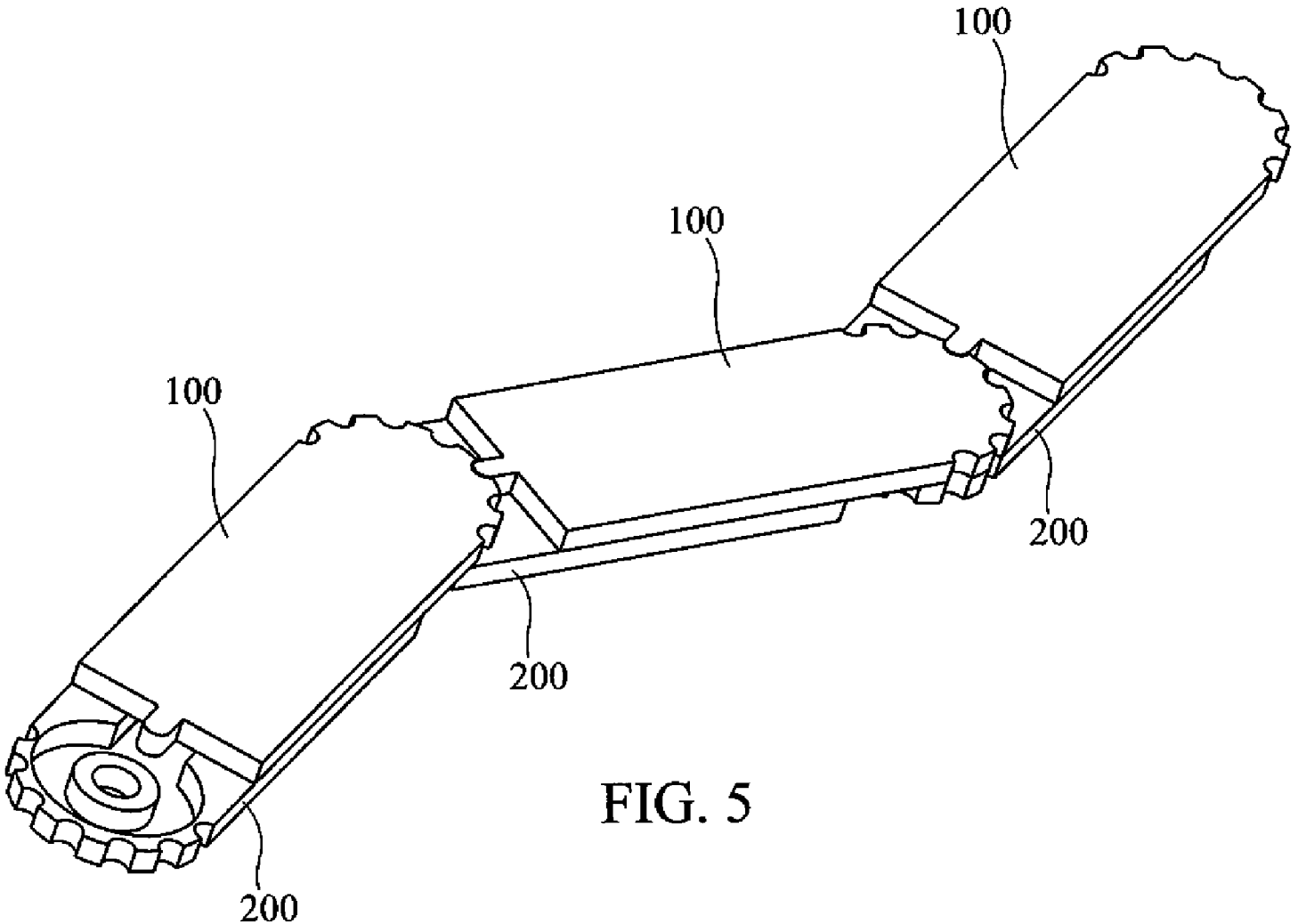
FIG. 5 shows a random shaped demolition line made up from three legs assembled according to this invention.
Figure 6:
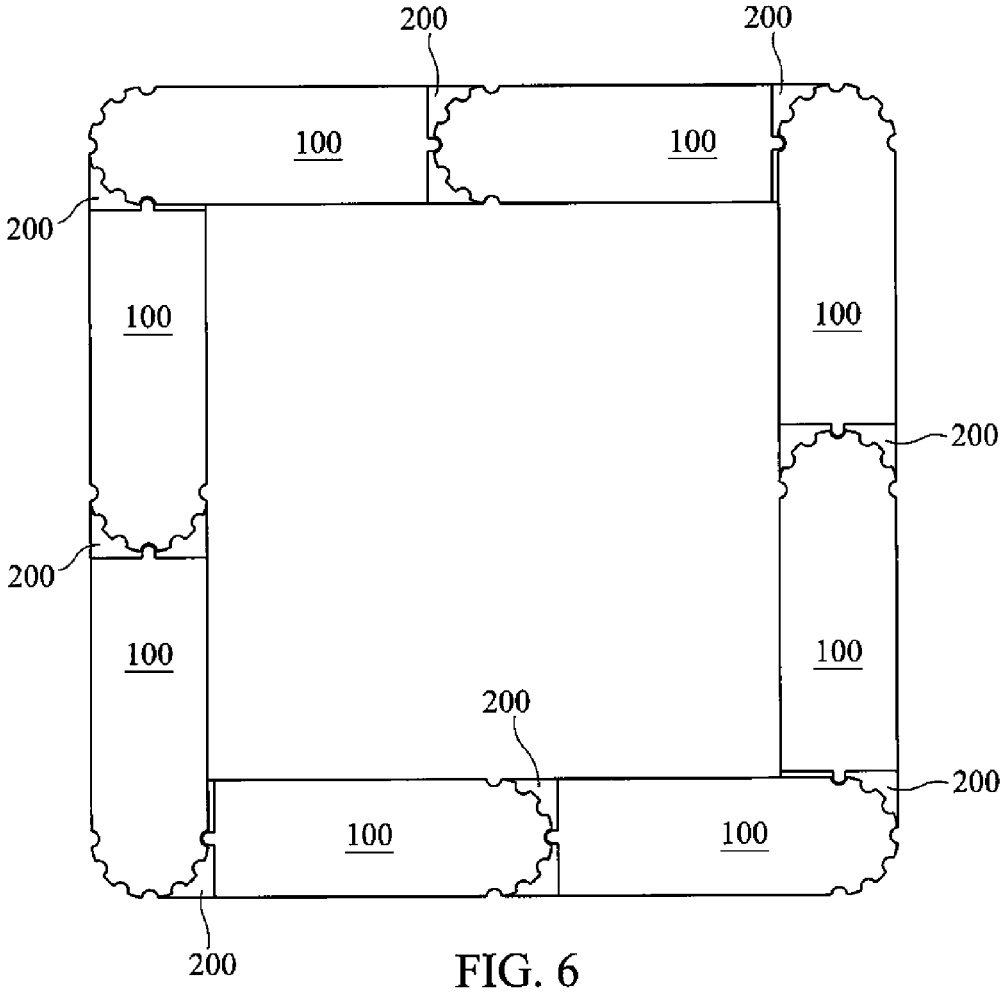
FIG. 6 shows a porthole shaped demolition device made from legs assembled according to this invention.
Figure 7:
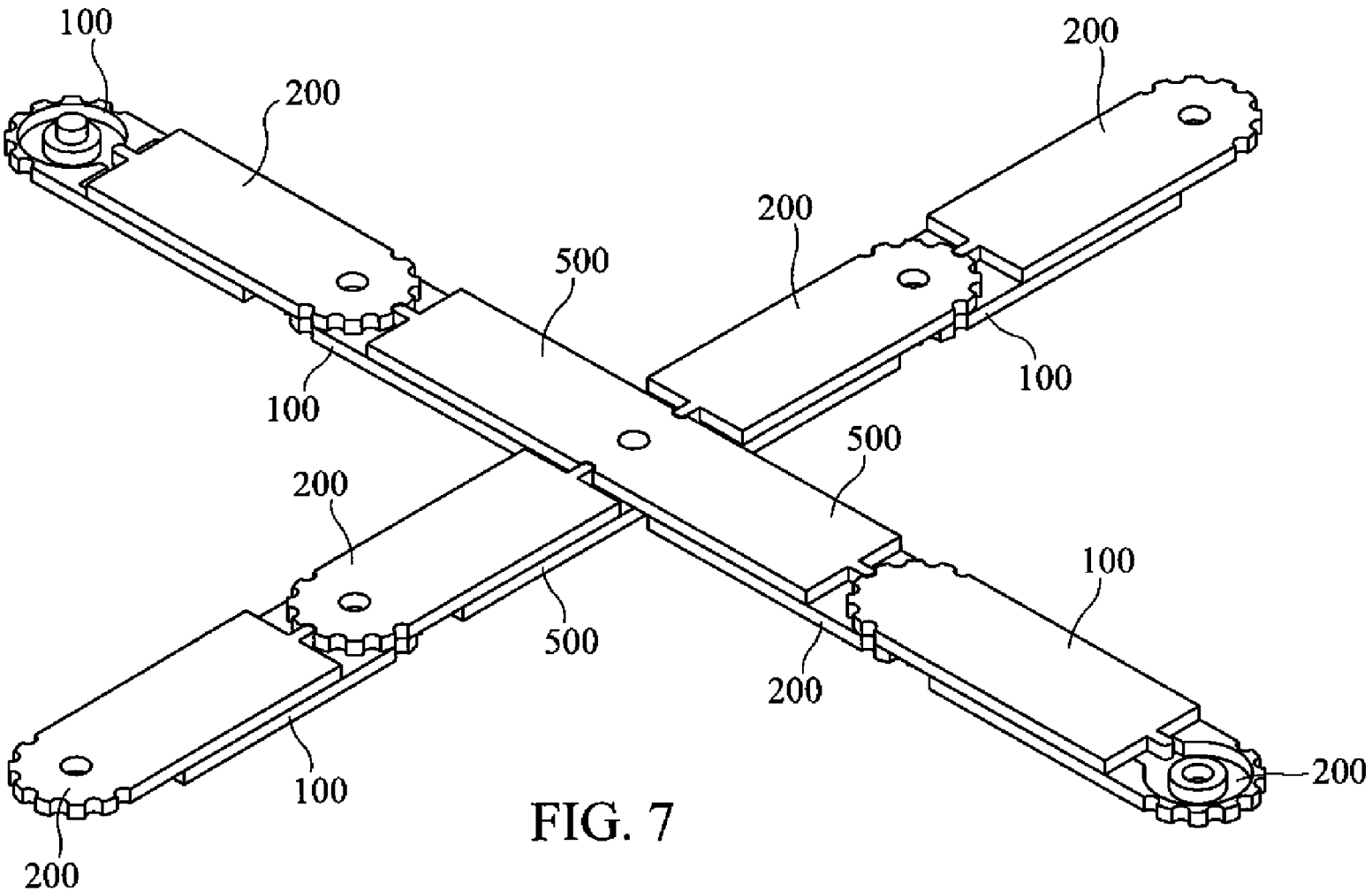
FIG. 7 shows an X-shape demolition device made from legs assembled according to this invention.
Figure 8:
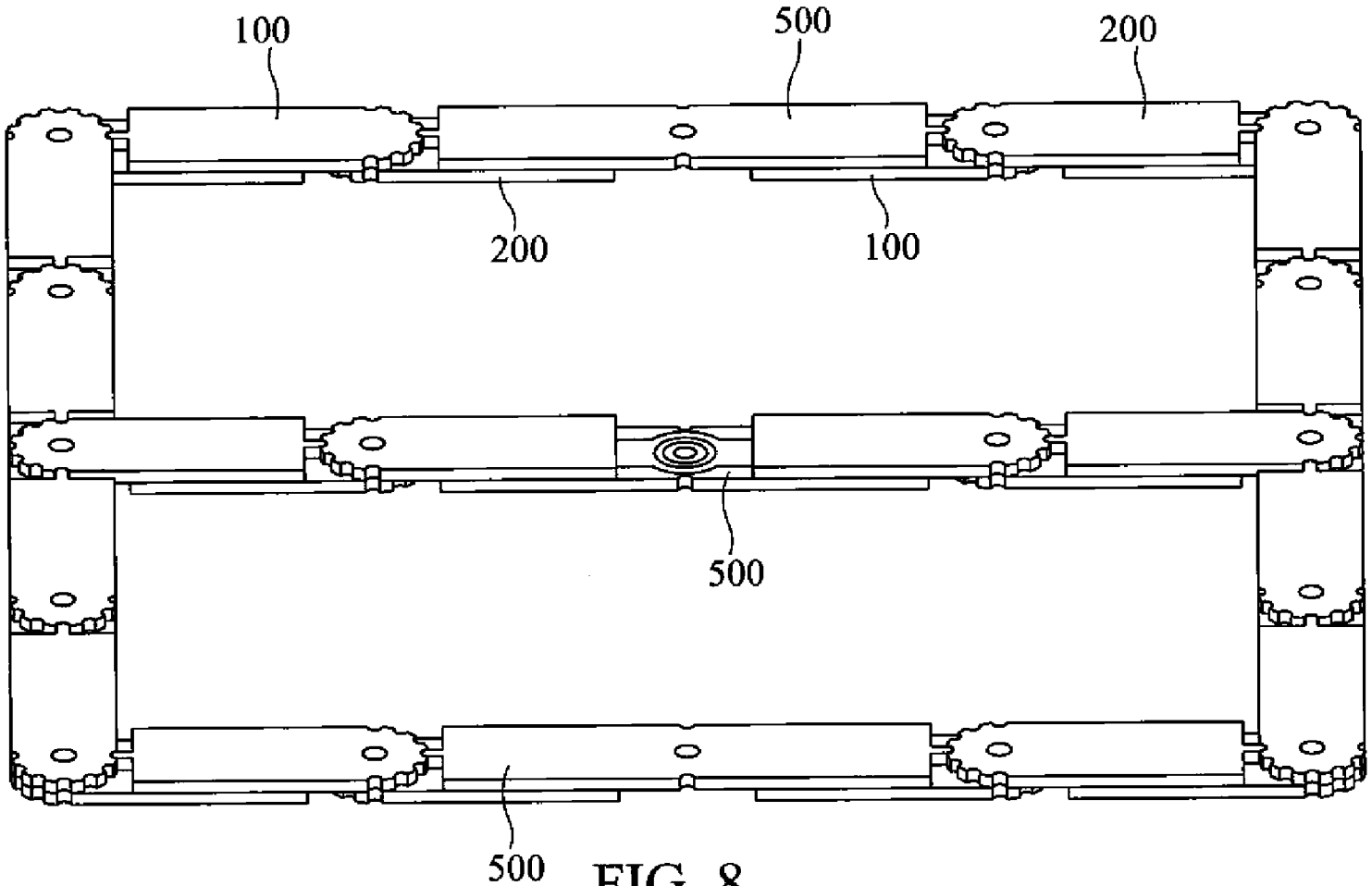
FIG. 8 shows a window frame like demolition device made from legs assembled according to this invention.
Figure 9A:
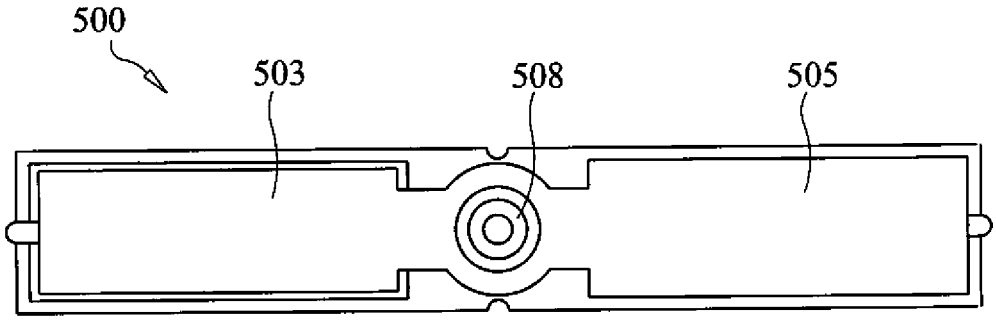
FIG. 9 shows a middle connect piece 500 according to this invention.
Figure 9B:
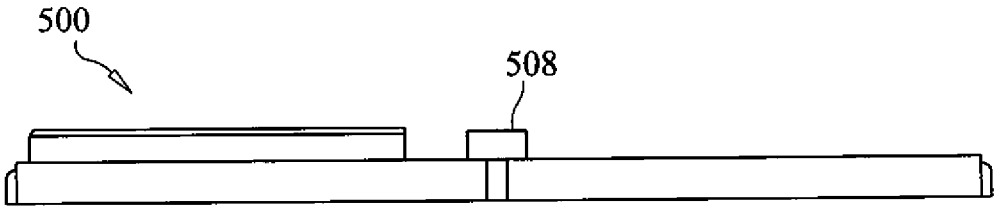
Figure 9C:
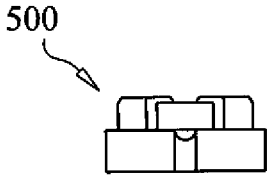
Figure 9D:
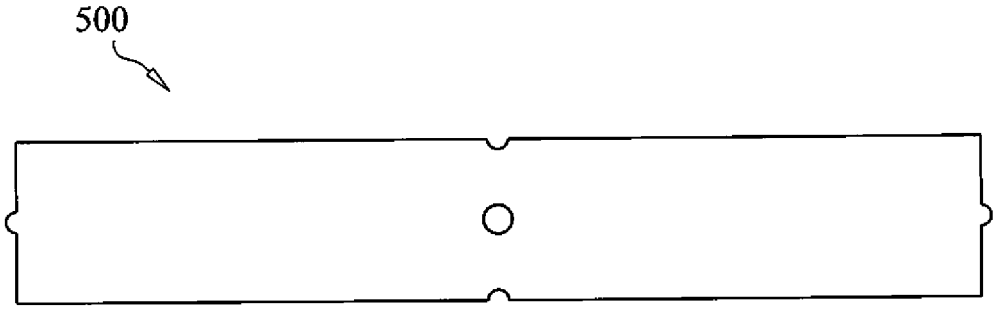
Figure 9E:
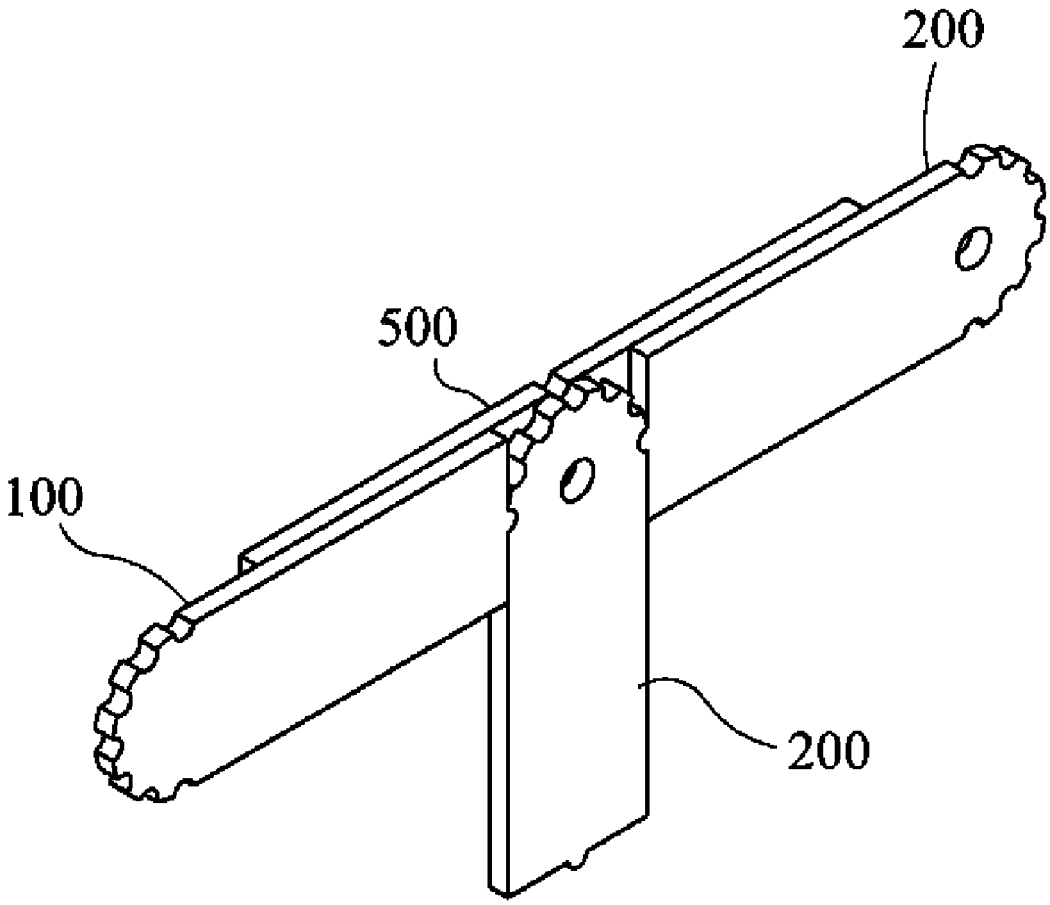

Ideally, to begin constructing a "chain", one begins with any two pieces (whether 100 and 200, or both 100, or both 200), and joins them in the "second configuration" as above described. That is, the post or hole parts of these pieces are made to not be adjacent or opposite one another, while the two rectangular box cavities are indeed adjacent and joined, then both snapped into one another permanently. These two will now be considered the "first leg" here in building up the chain. Thereafter, in either direction further pieces are mated onto this "first leg", at either end of this first leg, by inserting a respective post or a respective hole of a new respective piece into an exposed respective hole or post, as the case may be, adding onto the existing above described "first leg", and therefore likewise linked on. By adding on pieces theoretically ad infinitim in either direction, a chain could be created of any desired number of legs/pieces, with their flat portions alternately facing up or down (in one direction or in its opposite direction) towards the target. Like the leg, the chain would also be roughly an inch thick, but roughly two inches wide. The length of the chain depends on how many pieces are linked together. An entire geometric shape can be made of such chained pieces because it will be seen that the post (like 108) of a newly added piece may be rotated about its mating hole (like 206) by close to 90 degrees in either a clockwise or in a counterclockwise direction. This will change the direction the chain is aimed in and thus allow different, selected shapes to be created by a chain, or a joining of chains together. It will be seen that the rounded edge of piece 100 has gear shaped grooves 111 interspersed between more flat portions 115. These grooves 111 are sized for holding a small tab (such as 221 on a to be snapped in mating piece like 200, for example) or perhaps a tab 118 of another male piece 100 if the case might be. Thus, piece 100 can be clocked around the hole of piece 200 by close to 90 degrees in either a clockwise or a counterclockwise direction as was described, and held in place by such tab 221 being in a groove such as shown by 111 on a piece like 100. Likewise, piece 100 has a tab 118 sized to fit into a groove 215 on a mating piece like 200. Thus, a piece 200 could likewise be clocked around the post of a piece like a piece 100 by close to 90 degrees in either a clockwise or a counterclockwise direction, as was described. This enables the pieces in a chain to be set into a select direction at each juncture, and held by the lock of a tab in the serrated areas as was described. Chains can thus be made in many forms and contain many angles and lengths, and the chains can be combined as desired to form a larger "frame" that can be used for breaching or other demolition type tasks. Chains can be combined into, for instance, an irregular S-chain (FIG. 5), E-shapes, square shapes, cross-like shapes, other polygonal type shapes, spoke-like/snowflake type configurations when used with a hub piece 300, e.g., porthole configurations (FIG. 6), X-shapes (FIG. 7), and window frame like shapes (FIG. 8), for example, to be further described below. There are also other possible variations of shown pieces 100 and 200 to accommodate other functions, and the pieces could also be designed to be made in other sizes, dimensions, shapes, colors, and/or even color coded as may be needed or found desirable. A middle piece 500 for example, is a component for simultaneous joining legs/chains, of three different paths, at one juncture point.

Figure 3A:
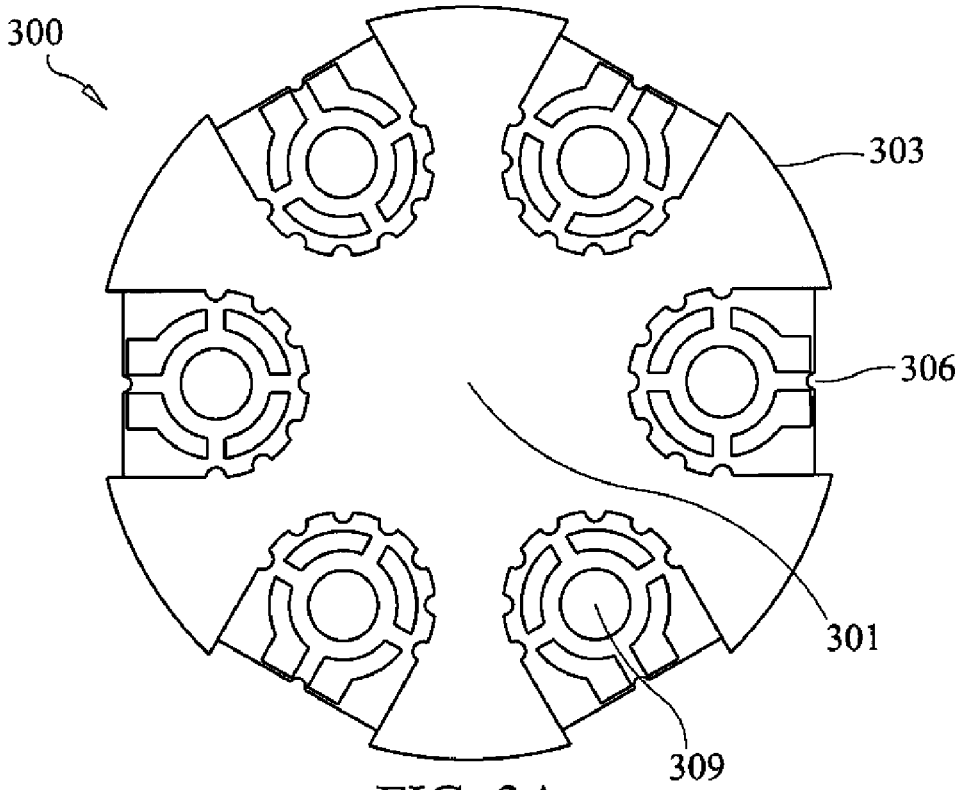
FIG. 3A shows a circular like hub piece 300 that can be used with pieces 100, 200 to build up a snowflake configuration for a demolition device according to this invention.
Figure 3B:
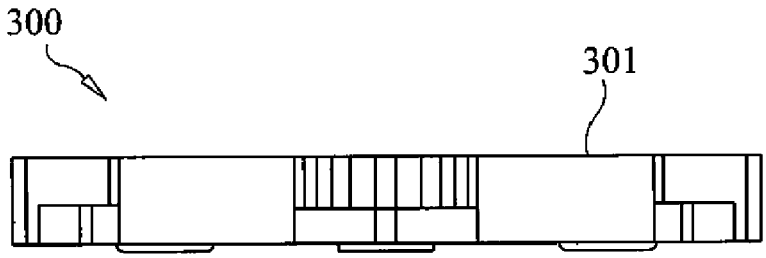
FIG. 3B shows a front side view of the circular like hub piece 300 of FIG. 3A.
Figure 3C:
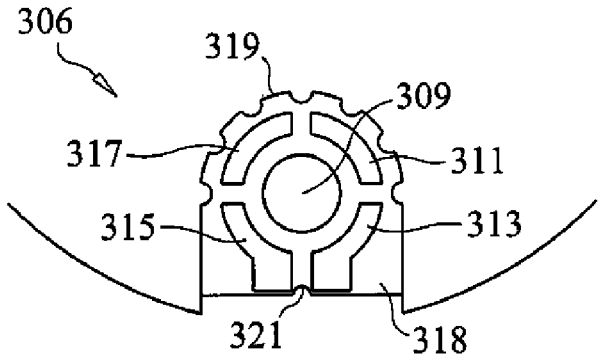
FIG. 3C shows a detailed view of a recessed area 306 found on the circular like hub piece 300 of FIG. 3A.

FIG. 3, (which has FIGS. 3A-3C), shows a round hub piece 300 which is used to create a snowflake pattern of pieces. Hub piece 300 has a bulging top surface 301. Though not fully shown here, the reverse side of hub piece 300 is open so as to be a cavity to receive explosive powder. The cavity is then fully closed by a flat matching backing piece (not shown) to simply enclose all of the back side of hub piece 300 and all of the explosive powder that may be loaded therein. The hub piece has 12 edges. Six respective equilaterally-located flat edges 303 are interspersed respectively with six respective partially rounded recessed areas 306, though a greater or lesser number of recessed areas may be used as may be necessary, to accommodate more (or fewer) spokes, for example. A more detailed view of a recessed area 306 is shown in FIG. 3C. Each recessed area 306 is a mate to receive a male piece 100. One respective male piece 100 is inserted respectively into each of the recessed areas 306. Post 108 of a male piece will plug right in to opening 309 of a recessed area 306. Serrated areas 115 on a male piece 100 will fit snugly into corresponding areas 319 here on a recessed area 306 of hub piece 300. The male piece 100 will be inserted until it rests flush upon flat surface 318 here in a recessed area 306 of hub piece 300. There are open areas 311, 313, 315, 317 in flat surface 318; their purpose is to insure contiguity of ignition contact between explosive inside 300 and explosive inside an inserted piece 100. The six male pieces 100 if inserted inside hub piece 300 as described, begin forming the spokes of a snowflake type structure. Through addition of female pieces 200, legs are built up, which in turn can be extended by further legs as may be desired. It will be seen that one could build up a snowflake pattern for example by interconnecting a hub piece and various pieces/legs. Detonation is only needed at one place in the snowflake. Because of ignition continuity as above described all parts of the snowflake should explode in unison. The hub piece is usually detonated at its center, but it will be appreciated that the hub piece could be used (without detonation cord), to divide out and spread detonation from just one plugged in leg (if detonated from elsewhere) to up to five other legs, if those other legs are also plugged in to the hub piece.

Figure 4A:
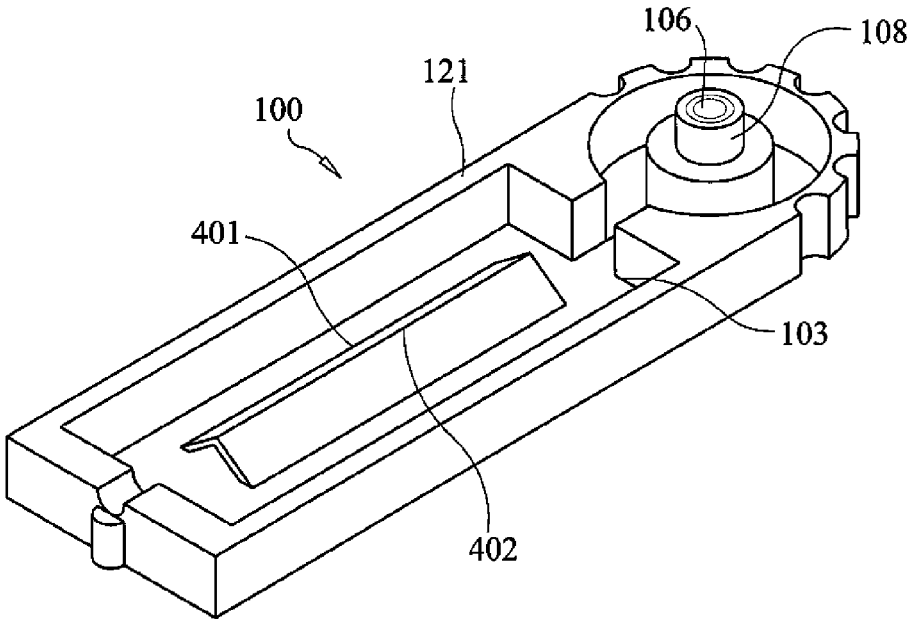
FIG. 4A illustrates placement of a shaped charge metallic liner 401 in a cavity of a piece 100, 200 for a demolition device according to this invention.
Figure 4B:
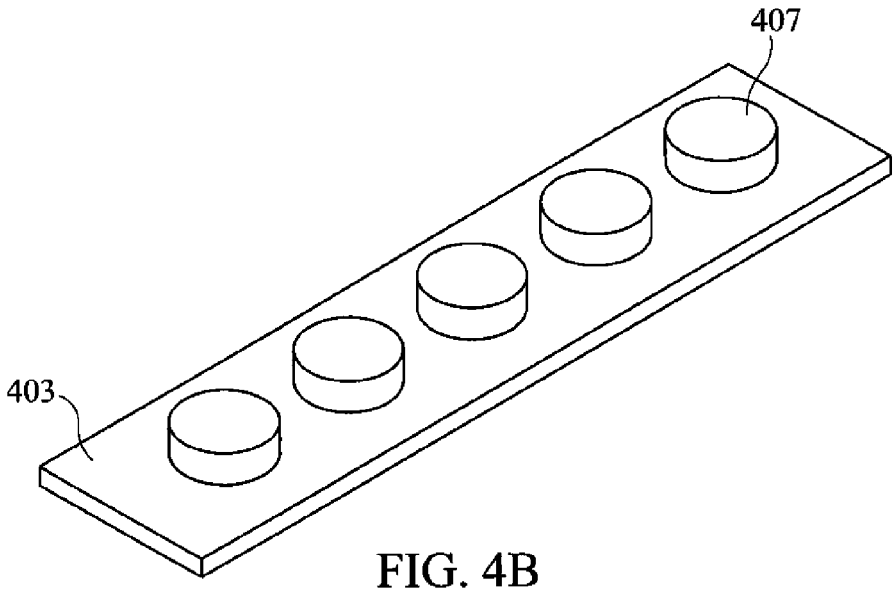
FIG. 4B illustrates a liner of explosively formed projectiles for insertion in a cavity of a piece 100, 200 for a demolition device according to this invention.

FIG. 4A generally shows the addition of a metallic liner/shape charge arrangement 401 into cavity 103 of a male piece (or cavity 203 of a female piece, e.g.). The metallic liner is a thin metal sheet roughly the length/width of the main cavity. The liner is made to be in a V-cross or C-cross sectional shape, with the crease fold part 402 positioned away from the direction the target will be. The volume lying above 401 is filled with explosive. When detonated, a line of molten metal (along the fold) ultimately should slam into the target at high speed, as the liner deforms. Instead of metallic liner 401, one could have a copper preformed EFP (explosively formed projectile) on 403, or a series of EFP's 407 lined up. Instead of placing the metallic liner or EFP's in the main cavity 103, 104, the metallic liner or EFP's could be placed in a false bottom cavity (not shown) of a male or female piece. The direction of orientation of the metallic liner or EFP's is as before still aimed towards the target and placement of explosive is as before above the liner so as to deform the metallic liner or EFP's into the direction of a target. Metallic liners or EFP's can also be used without, or with, a further presence of explosive within the other legs of the chain (or hub piece), as may be desired.

Detasheet® (sheet explosive) may be placed in a leg (or legs) or between a leg (or legs) and the target. In such case, the detasheet® is trimmed to the outline profile of the frame (and hub piece if any) as against the target (it may also be used untrimmed in the proper cases as best known to the soldier). The detasheet® may also be wrapped entirely around a leg (both above the leg, draping down the long sides of the leg, then completely under the leg over against the target) or of the entire frame. Detonation of such detasheet® in known manner will produce a satisfactory breakage into the target, along the outline profile of the frame (and hub piece if any). The detasheet® can also be used without, or with, a loading of explosive or within the legs or hub piece, as may be desired. In fact, one use of the MDBS according to this invention, is simply to form an inert frame structure around which datasheet may be deployed, to breach a target. This can happen by design or in a case where the soldier might run out of explosive in the field, for instance.

It will be appreciated that the MBDS provides a soldier with a very versatile, lightweight system, having simple snap together building blocks, which can be conveniently loaded as desired with explosives, used with detasheet®, or metallic liners/EFP's, pre-form fragments such as balls, cubes, stars, etc., and used against a target. The soldier does not have to look for hard to obtain natural objects to build up a frame to support his demolition needs with an MBDS.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A lightweight field demolition system comprising inert modular pieces for customized assembly thereof into a frame as a breaching or demolition system, said system further comprising:

sufficient quantities of at least two basic types to make a line, three basic types to make a line and a branch off such line, or four basic types to make a hub and branch off said hub, of plastic components that can be selectively snapped together making a frame without need of specialized tools, said types comprising a male piece, a female piece, a central hub piece, and a middle connect piece;

plasticized explosive which can be selectively loaded into said frame components;

a customized single detonation point utilizing a blasting cap or detonation cord, of sufficient length to safely allow detonation of one or more of the frame components from a safe distance; whereas, each male piece comprises a post and has a male piece longitudinal axis and each female piece comprises a hole and has a female piece longitudinal axis which mates to said post, so that alternate male and female pieces may be joined together to form a string of joined modular pieces which can be applied to a target for demolition purposes, and wherein a joint of male piece to a female piece, post in a hole, can be angled at up to plus or minus 90 degrees of male piece longitudinal axis with respect to a female piece longitudinal axis.

2. The demolition system of claim 1 wherein said frame can be used to support the positioning of trimmed or untrimmed sheet explosive between frame and a selected target.

3. The demolition system of claim 1 wherein said frame can be used to support the positioning of trimmed or untrimmed sheet explosive inside the frame and applied to a selected target.

4. The demolition system of claim 3 wherein the liner is a shaped charge device.

5. The demolition system of claim 3 wherein the liner is an EFP device.

6. The demolition system of claim 3 wherein the liner is a pre-formed fragment device.

7. The demolition system of claim 3 wherein the task is breaching into a target structure.

8. The demolition system of claim 3 wherein the task is entire demolition of a target structure.

9. The demolition system of claim 3 wherein the task is demolition of excess ammunition or other material.

10. The demolition system of claim 1 wherein pieces of said frame can be selectively loaded with detonation cord, as a soldier may require for a particular task.

11. The demolition system of claim 1 wherein pieces of said frame can be selectively loaded with a fragment producing metallic or non-metallic liner, as a soldier may require for a particular task.

12. The demolition system of claim 1 wherein pieces of said frame can be selectively loaded with fragment producing explosively formed penetrators, as a soldier may require for a particular task.

13. The demolition system of claim 12 wherein the task is breaching into a target structure.

14. The demolition system of claim 12 wherein the task is entire demolition of a target structure.

15. The demolition system of claim 1 wherein the explosive is pre-loaded before being brought into the field.

16. The demolition system of claim 1 wherein the explosive is C-4 explosive.

17. The demolition system of claim 1 wherein the system does not require the locating and use of any further natural resources in the field for a soldier to successfully accomplish a task.

18. The demolition system of claim 1 wherein the components are made of an inert, sturdy, metallic, lightweight material other than plastic.

19. The demolition system of claim 1 wherein the components are made of an inert, sturdy, non-magnetic, non-metallic, lightweight material other than plastic.

20. The demolition system of claim 19 wherein the non-metallic materials can further be impregnated with metallic particles such as aluminum which can enhance the high explosive effects.

21. The demolition system of claim 19 wherein the non-metallic materials can further be reinforced with fibers to make the pieces and the frame more rigid.

22. The demolition system of claim 1 wherein the components are made of an inert, flexible, non-magnetic, non-metallic, lightweight material other than plastic.

23. The demolition system of claim 1 wherein the components are made of an inert, sturdy, magnetic, lightweight material other than plastic.

24. The demolition system of claim 1 wherein the components are made of an inert, sturdy, non-magnetic, non-metallic, lightweight material other than plastic and integrated with a magnetic material.

25. The demolition system of claim 1 wherein a hub piece has up to six male pieces plugged therein to generate a spoke wheel, snowflake like shaped frame for demolition purposes.

26. The demolition of claim 1 wherein each male piece has a rounded gear like part with circumferential grooves, concentric to the post, and at the opposite end of the male piece there is a protruding tab; and wherein each female piece has a rounded gear like part with circumferential grooves, concentric to the hole, and at the opposite end of the female piece there is a protruding tab; whereby the tab of each piece fits into a groove of each adjacent piece, thereby locking in place the relative direction of adjacent pieces that had been selected.

27. The demolition system of claim 26 wherein a joint of male piece to a female piece, post in a hole, can be angled at up to plus or minus 90 degrees of male piece longitudinal axis with respect to a female piece longitudinal axis, making possible the formation of a straight or a serpentine shaped string of joined modular pieces which straight or serpentine shaped string can be applied to a target for demolition purposes.

28. The demolition system of claim 26 wherein a joint of male piece to a female piece, post in a hole, can be angled at up to plus or minus 90 degrees of male piece longitudinal axis with respect to a female piece longitudinal axis, making possible the formation of a string of joined modular pieces which ends are joined in a continuous loop and which continuous loop string can be applied to a target for demolition purposes.

29. The demolition system of claim 26 wherein a joint of male piece to a female piece, post in a hole, can be angled at up to plus or minus 90 degrees of male piece longitudinal axis with respect to a female piece longitudinal axis, making possible the formation of a string of joined modular pieces which ends are joined in a continuous loop in the shape of a circle and which circular string can be applied to a target for demolition purposes.

30. The demolition system of claim 26 wherein a joint of male piece to a female piece, post in a hole, can be angled at up to plus or minus 90 degrees of male piece longitudinal axis with respect to a female piece longitudinal axis, making possible the formation of a string of joined modular pieces which ends are joined in a continuous loop in the shape of a rectangle and which rectangular string can be applied to a target for demolition purposes.

31. The demolition system of claim 26 wherein a middle connect piece can be used with male and female pieces to form a T-shaped or X-shaped frame of modular pieces which can be applied to a target for demolition purposes.

32. The demolition system of claim 26 wherein a middle connect piece can be used with male and female pieces to form a window-shaped frame of modular pieces which can be applied to a target for demolition purposes.

* * * * *